US007399406B2

(12) United States Patent
Mikula et al.

(10) Patent No.: US 7,399,406 B2
(45) Date of Patent: Jul. 15, 2008

(54) PROCESSING OF OIL SAND ORE WHICH CONTAINS DEGRADED BITUMEN

(75) Inventors: Randy Mikula, Devon (CA); Vicente Munoz, Devon (CA); Brad Bjornson, Fort McMurray (CA); Doug Cox, Fort McMurray (CA); Anita Marks, Fort McMurray (CA)

(73) Assignee: Suncor Energy, Inc., Calgary, Alberta (CA)

( * ) Notice: Subject to any disclaimer, the term of this patent is extended or adjusted under 35 U.S.C. 154(b) by 726 days.

(21) Appl. No.: 10/136,332

(22) Filed: May 2, 2002

(65) Prior Publication Data

US 2003/0205507 A1 Nov. 6, 2003

(51) Int. Cl.
*C10G 19/00* (2006.01)

(52) U.S. Cl. ..... 208/390; 391/401

(58) Field of Classification Search ..... 208/390, 208/391, 401

See application file for complete search history.

(56) References Cited

U.S. PATENT DOCUMENTS

| | | | | |
|---|---|---|---|---|
| 4,437,998 | A * | 3/1984 | Yong | 210/728 |
| 4,783,268 | A * | 11/1988 | Leung | 210/703 |
| 5,017,281 | A * | 5/1991 | Sadeghi et al. | 208/390 |
| 5,985,138 | A * | 11/1999 | Humphreys | 208/391 |
| 6,768,115 | B2 * | 7/2004 | Mikula et al. | 250/339.11 |

FOREIGN PATENT DOCUMENTS

| | | | |
|---|---|---|---|
| CA | 841581 | 5/1970 | |
| CA | 1044628 | 12/1978 | |
| CA | 1094003 | 1/1981 | 196/17 |
| CA | 1214421 | 11/1986 | 196/19 |
| CA | 1270220 | 6/1990 | 196/19 |
| CA | 2208767 | 12/1998 | |

OTHER PUBLICATIONS

Minespace 2001, Presentation slides, "*Identification and Treatment of Weathered Ores at Suncor's Steepbank Mine*", May 2, 2001, Quebec City, Canada.

District 5 CIM Conference, Presentation slides "*Identification and Treatment of Weathered Ores at Suncor's Steepbank Mine*", Jun. 14, 2001, Alberta, Canada.

FTFC (Fine Tailings Fundamentals Consortium), 1995, "*Advances in Oil Sands Tailings Research*", vol. 1, section 2.0-2.9, Alberta Department of Energy, Oil Sands and Research Division, Publisher.

(Continued)

*Primary Examiner*—Tam M. Nguyen
(74) *Attorney, Agent, or Firm*—Knobbe, Martens, Olson & Bear LLP

(57) ABSTRACT

Methods are disclosed for identifying and treating oil sand ores having degraded bitumen. This can be done by considering the location from which the ore is mined or its history, or by microscopic examination of a bitumen froth made from the ore, or by near-infrared spectroscopy. Ore which contains degraded bitumen is treated with at least 0.05 wt/wt % alkaline material, preferably 0.1 wt./wt % of such alkaline material, in the water addition step of a hot or warm water extraction process for the making of bitumen froth, such as the Clark process.

20 Claims, 4 Drawing Sheets

OTHER PUBLICATIONS

Schramm et al., (1984) AOSTRA Journal of Research, vol. 1, pp. 5-13.

Schramm et al., (1987) AOSTRA Journal of Research, vol. 3, pp. 215-224.

AIChE 2001 Annual Meeting, Session 11-"*Recent Advances in Fluid/Particle Separation*", Nov. 6, 2001, Reno, Nevada.

Schramm, et al., "Two Classes of Anionic Surfactants and Their Significance in Hot Water Processing of Oil Sands", Can. J. Chem. Engl, 65 (1987) pp. 799-811.

Schramm, et al., "Some Observations on the Aging Phenomenon in the Hot Water Procesing of Athabasca Oil Sands. Part 1 - The Nature of the Phenomenon", Aostra J. Res., 3 (1978) pp. 195-214.

Wallace, et al., "A Physical Chemical Explanation for Deterioration in the Hot Water Processability of Athabasca Oil Sands Due to Aging", Fuel Sci. Technol. Int., 7 (1989) pp. 699-725.

Office Action for Canadian Patent Application No. 2,385,311, issued by the Canadian Intellectual Property Office, dated Feb. 8, 2007.

Kasperski, et al., "The CANMET Experience with Poorly Processing Ores", CANMET Western Research Centre, CANMET presentation to CONRAD "Problem Ores" Meeting, Ft. McMurray, Alta., Ca, Mar. 2000.

* cited by examiner

PROCESSING OF OIL SAND ORE WHICH CONTAINS DEGRADED BITUMEN

This invention relates to the processing of oil sands, in a hot or warm water process for separating bitumen from an ore mined from such oil sands.

BACKGROUND OF THE INVENTION

The oil sands located in northern Alberta, Canada contain heavy bitumen with a gravity of approximately 8 API, in concentrations of 6 to 14 wt. %. The Alberta oil sands form one of the world's largest known sources of oil.

A considerable amount of this resource is accessible by surface mining methods, and major mining of these oil sands takes place. However, the costs of extracting, treating and up-grading bitumen are high. Accordingly it is desirable to improve the process steps to maximize bitumen recovery from the oil sands which are mined.

Techniques for the surface extraction of bitumen from oil sands are well known in the industry. The oil sands are mined and crushed to form a crushed ore (called "ore" or "oil sand ore" in this application).

An established commercial method for the processing of oil sand ore is the hot or warm water extraction process. This is sometimes known as the "Clark Process", although many variants of it now exist. This extraction process treats the ore with steam or water or a mixture of the two with agitation in air to produce an aerated bitumen froth. The temperature of treatment varies, but is usually in the range of 40° C. to about 85° C. or higher. This process is sometimes called a "warm water" process when the water temperature is below about 50° C., and a "hot water" process when the temperature is higher, but both the warm and hot water processes will be described collectively in this application as a "hot water process". A typical composition of the bitumen froth from such a process (excluding the air which forms it into a froth) is approximately 60 to 65 wt. % bitumen, 30 to 40 wt. % water and 5 to 10 wt. % minerals. The minerals are present as small solid particles.

It is known to add sodium hydroxide (NaOH) along with the hot water or steam in the hot water bitumen extraction process. This is done when there is a high "fines content" (which is defined in the industry as the fraction of solid particles of less than 44 micrometers in size), or when there is a low bitumen content. Generally, if there is a fines content above about 10-15% by weight, some sodium hydroxide is added, and the greater the fines content, the greater the amount of sodium hydroxide which is added. Also, sodium hydroxide can be added to increase bitumen extraction when the ore contains only a small percentage of bitumen. Low bitumen content and high fines content are often found in the same ore. "Very high grade" ore (which is defined as ore containing more than 12% by weight of bitumen) or "high grade" ore (which is defined as ore containing 11-12% bitumen, do not have sodium hydroxide added to them during hot water bitumen extraction. The amount of sodium hydroxide present in commercial hot water bitumen extraction processes can vary from no sodium hydroxide at all (for rich ores containing a lot of bitumen and relatively small amounts of fines) to approximately 0.03 wt. % of sodium hydroxide based on the weight of the ore for very low-grade ores which contain little bitumen and large amounts of fines.

It is recognized in the industry that sodium hydroxide should be used as little as possible in the hot water treatment process, having regard to the need for controlling fines and extracting bitumen from poor ores. This is because sodium hydroxide addition increases the cost of the treatment process. Also, it is known that sodium hydroxide delays seriously the settling rate of tailings (the mixture of minerals, clay and water which is left over after extraction of the bitumen). This increases the difficulty of managing the disposal of the tailings. Also, it is found that addition of sodium hydroxide beyond a certain optimum level for any particular ore does not increase bitumen production: in fact, it may reduce it.

Although the role of sodium hydroxide in bitumen froth production is not well understood, a few studies have linked it to the production of natural surfactants. It has been said that aged bitumen may be deficient in surfactants, and sodium hydroxide could cause some to be generated. See articles by Schramm et al., (1984) *AOSTRA Journal of Research*, vol 1, page 10, and (1987) *AOSTRA Journal of Research*, vol 3, page 215. However, this work has not led to any method of identifying bitumen which is lacking in such surfactants, or to any practical process of treating such ores. Further, the amount of sodium hydroxide which is suggested in these articles for addition to high grade ore is low, being about 0.01 weight %.

Generally, oil sand treatment by the hot water bitumen extraction process is quite effective, and leads to good recovery of bitumen as bitumen froth. It is sometimes found, however, that, as the hot water process is running as a continuous ore treatment process, the bitumen froth output from it increases in density, because the ratio of mineral and water content in the froth increases markedly and the bitumen content decreases. This can lead to plugging up of the froth treatment equipment, such as centrifuges, and hence force the process to shut down. When the problem is not severe enough for a shutdown, it can still lead to reduced recovery of bitumen. Similarly, batch processes, even those running high or very high grade ores, can sometimes give rise to high density froth without any obvious reason.

Inspection of the ores which are implicated in the increased density problems in the hot water process does not give obvious indicia which are different from other ores. Many are high grade or very high grade ores. Sometimes, but not always, the ores show signs of oxidation (for example, elevated iron, calcium or magnesium content indicative of a oxidation of iron sulphide to iron sulphate). However many of the ores which give high densities of froth or low bitumen recoveries do not show these features.

The ores implicated in the increased density problems are not "poor" ores in the classical sense of the term. Their fines content and bitumen content do not differ significantly from other ores from the same ore body which process satisfactorily in the hot water process. For example, high density froth problems can occur even with ores having 14% bitumen content or more, which is extremely high grade ore. Typically, ore with this bitumen content would give a froth with under 10% mineral. Much higher mineral concentrations than this are observed with the increased density ores, leading to plugging of equipment.

DESCRIPTION OF THE INVENTION

It has been found that the elevated density of froth, the increased mineral to bitumen ratio, and reduced recovery of bitumen which occasionally occurs in the hot water bitumen extraction process, can be related to the fact that the bitumen in the oil sand ore which is being treated has been degraded. The degraded condition can be predicted by knowledge of the location from which the ore has been mined and its history, or can be ascertained by microscopic or near-infrared spectrographic examination.

It is also found that the problems caused by degraded bitumen in the hot water process of bitumen extraction can be corrected or greatly reduced by a very large addition of an alkaline material to the water added to the ores for the process. The weight of alkaline material added is in excess of 0.05 wt % of the problem ore, and preferably more than 0.10%. It is particularly preferred to add in excess of 0.15 wt. %. (By wt.

% is meant the ratio, in percentage terms, of the dry weight of the alkaline material added to the weight of the ore). These amounts are much higher than amounts which are added in normal commercial hot water processes to any ore, especially an ore with a high bitumen content. Indeed, it is rare to add more than 0.03% alkaline material to ore for commercial hot water process treatment, even if in the case of ore with a very high fines content.

According to an illustrative embodiment of the invention, therefore, procedures are undertaken to determine whether bitumen in oil sand ore has been degraded, before such ore is presented for treatment in the hot water bitumen extraction process. If it is concluded that the ore is likely to contain degraded bitumen, extra alkaline material is added to the process water. This can be done by increasing the amount of sodium hydroxide present (or adding sodium hydroxide if none is present) or by adding another alkaline material. The alkaline material should be one which is fully soluble in the water at the temperature of the process, so that it will not provide insoluble matter during the bitumen extraction. A particularly preferred alkaline material is a proprietary mixture of sodium carbonate and some sodium bicarbonate, which is sold under the trademark Geosol™.

DESCRIPTION OF THE DRAWINGS

Illustrative embodiments of the invention will be further described with reference to the drawings, in which.

DETAILED DESCRIPTION OF THE INVENTION

Figure 1:
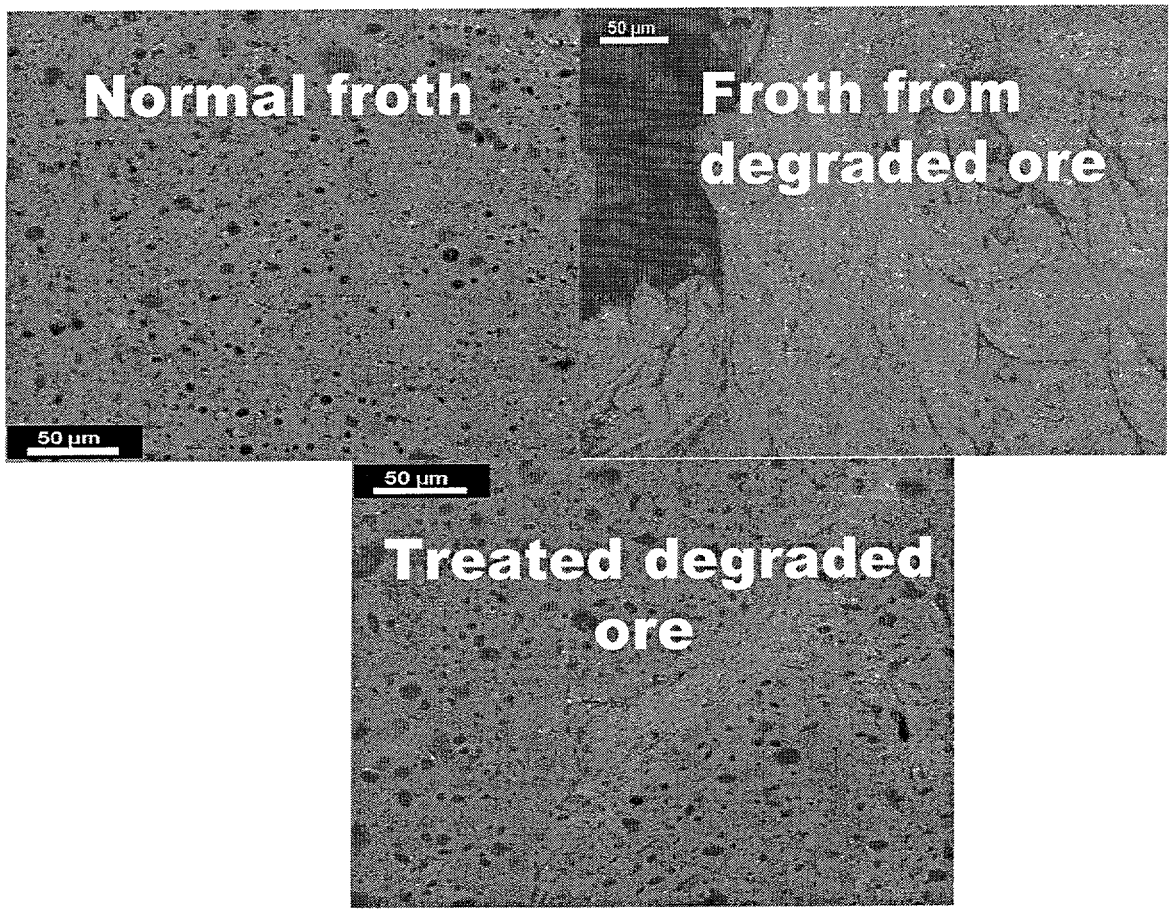
FIG. 1 is three confocal light scanning photomicrographs of bitumen froth, one (on the top left) from bitumen froth produced from normal ore, one (on the top right) of bitumen froth produced from ore with degraded bitumen, and one (on the bottom) of bitumen froth produced from ore containing degraded bitumen, using the process of an illustrative embodiment of the invention.

According to an illustrative embodiment of the invention, ore to be fed to a hot water or hot water and steam extraction treatment for the extraction of bitumen as froth is evaluated to see whether it contains degraded bitumen.

Evaluation according to illustrative embodiments can take place in several ways. First, the location from which the ore is being removed can be noted, as can the history of the ore after removal, and an inference as to the likely degree of bitumen degradation can be made based on such location and history and the application of certain rules. Alternately, testing can be done as described herein to determine the presence or absence of indicia which are associated with bitumen degradation.

Dealing first with the location from which the ore is being removed, three rules can be applied to determine whether the ore is to be considered as containing degraded bitumen for the purpose of illustrative embodiments. These are:

1. Ore which has a very small depth of covering is likely to contain degraded bitumen by reason of weathering over geological time periods. Therefore, ore removed from a location which has a covering of less than approximately 12 meters (i.e., ore that is less than approximately 12 meters from ground surface, measured from the ground level before mining commenced) can be regarded as containing degraded bitumen. This rule can be modified by one skilled in the art, based on the condition and type of the overburden, as different types of overburden shield the ore more or less from geological weathering. Thus in particular circumstances, the appropriate distance from the ground surface may be slightly more or less than 12 meters, as will be understood by a skilled person.

2. Where ore has been exposed to the elements for some time, because the overburden has been removed and subsequently the ore has not been mined immediately, or where the ore has been mined and then exposed to the elements before processing, this ore can be regarded as containing degraded bitumen. The precise amount of time that the ore can be exposed to the elements before the bitumen is degraded is variable, depending on climatic conditions, whether the exposure is in summer or winter, and precipitation. However, as a rule, any ore exposed to the elements for at least one month after stripping of the overburden before mining, and any ore stored after mining exposed to the elements for at least one month before hot water process treatment, can be regarded as containing degraded bitumen.

3. Ore which is from a location within the ore body which is within 12 meters from an underground aquifer (with active water movement) is considered to contain degraded bitumen. Again, a person skilled in the art may modify this rule based on the geology of the particular site, depending on the probability that the water has contacted the ore.

In the alternative to evaluating ore as containing degraded bitumen by reason of its location or history, testing can be performed on the ore to determine whether it in fact contains degraded bitumen. There are several ways to do this. One way is by microscopic examination of froth produced using the ore. Degraded bitumen produces a froth with a recognizable bitumen structure which is different from that of undegraded bitumen. Thus, froth samples can be created, in a hot water bitumen extraction process, or in a laboratory simulation of a hot water bitumen extraction process, and the morphology of the bitumen in such froth samples can be characterized microscopically. A set of parameters has been developed for identifying the microscopic characteristics of ore which contains degraded bitumen. If one or more of these parameters is present, alkaline material addition is likely to be of benefit.

It is found that froth made from degraded bitumen has clearly visible excess water and mineral in it, in larger agglomerations than are present in ore which does not contain significant amount of degraded bitumen. In a froth made from ore without degraded bitumen, it is rare to see water or mineral inclusion having a largest visible dimension under a microscope of greater than about 20 micrometer. However, when the bitumen is degraded, it is not uncommon to see inclusion which are linear as viewed under the microscope and are often 100 micrometers or more in lenght. It is also not uncommon to see large irregular bodies having a dimension greater than 100 micrometer in their longest direction.

Generally, there are four types of structures which can be identified when a froth containing degraded bitumen is examined:

| Morphological Feature | Physical Description |
|---|---|
| String Structures | These are fibre-like or needle-like structures and range from about 5 μm to over 100 μm in length. |
| Skin or Flat Structures | The x-and/or y-dimensions of these structures are about 10 times the z-dimension, and they often appear as patches of skin on normal bitumen. |
| Dendritic Structures | These structures seem to develop from a string-type structure that bifurcates and assumes a dendritic microscopic morphology. They range in size from about 50 μm to over 300 μm. |

-continued

| Morphological Feature | Physical Description |
|---|---|
| Sheet and Globule Structures | These are the largest and most complex and three-dimensional structures found in degraded bitumen froths. They are found in froth samples having high concentrations of degraded bitumen (>80%) and their x-y size ranges from about 150 μm to over 300 μm with a depth (z-axis) of about 200 μm. |

If a froth exhibits any of these structures, or a microscopic inclusion with a dimension greater than 100 micrometers, it can be considered that it is likely to contain degraded bitumen which would benefit from treatment according to this embodiment. However, not all of these structures are present in all froth samples having degraded bitumen, and occasionally one may be present in a sample which does not include degraded bitumen. Therefore, although it is possible to determine the presence of degraded bitumen with reasonable accuracy from a single microscopic sample or a small group of samples, it is preferred to take a plurality of microscopic samples, for example 20 or more, of a froth which is suspected to contain degraded bitumen. This increases the size of sample being studied. If more than 20% of the microscopic samples (ie., more than four samples out of 20) exhibit at least one of the four features or a microscopic inclusion with a dimension greater than 100 micrometers, it can be concluded that the ore from which the froth is made has degraded bitumen, and treatment according to this embodiment would be beneficial.

Additionally, when the samples are fluoresced under the microscope, samples with degraded bitumen often exhibit dark bands, even when the other microscopic indicia of degraded bitumen are not present. If dark bands are seen when the microscopic sample or samples are fluoresced, it can be concluded that the ore from which the froth is made is likely to contain degraded bitumen, and treatment according to this embodiment would be beneficial. However, it is preferred that dark bands be present in at least 5% of the samples, before it is decided to treat according to this embodiment.

A still further way of determining whether the ore contains degraded bitumen is to use near infrared reflectance (NIR) spectra. Examination of a number of samples of the same given ore after varying periods of simulated weathering (to cause an increase in the degradation of bitumen) shows that the baseline absorbance of the near infrared spectra decreases as the bitumen becomes degraded. Further, it is found that the $CH_2$ peak intensity (a peak at approximately 1723 nm) decreases as the amount of degraded bitumen increases, and the OH peak (at approximately 1936 nm) increases. Thus, an infrared spectrometer can be placed above oil sand ore moving on a conveyor belt, to produce continuously a measurement which is indicative of the degree of degradation of the bitumen of the oil sand ore. For each general type of oil sand ore, values can be established for the baseline absorbance, $CH_2$ peak intensity and/or the OH peak in samples which process without trouble in the hot water bitumen extraction process. Oil sand ore showing a decreased absorbance baseline, decreased $CH_2$ peak intensity and/or increased OH peak intensity an arbitrary amount outside those values can be considered as containing degraded bitumen and hence as being an ore which would be benefited by treatment with alkaline material. For example, it can be decided that, for a particular ore, alkaline material or increased alkaline material will be added to a continuous hot water process at any time when NIR spectroscopy shows a decrease in the absorbance baseline of (for example) 20%, or a decreased $CH_2$ peak intensity and/or increased OH peak intensity of (for example) 20%.

Once it is determined, by any of the above methods, that the ore does include degraded bitumen, treatment by adding an alkaline material, on amounts as described above, is appropriate. The alkaline material can conveniently be dissolved in water and added to the water being used to form the bitumen froth. The effect of the alkaline material is enhanced when it has increased contact time with the ore. Therefore, it is preferably added when the water first contacts the ore. In a system where the ore is transported by hydraulic transfer from the minesite to the location where the hot water extraction takes place, it is preferred that the alkaline material be added where the water is first added for hydraulic transfer, to increase the contact time.

It is also preferred where feasible to blend the ore containing degraded bitumen with regular ore which does not contain significant amounts of degraded bitumen, to reduce the amount of degraded bitumen being processed at any one time. For example, 30% by weight of ore containing degraded bitumen can be blended with 70% of regular ore. The amount of alkaline material added is dependent on the amount of ore containing degraded bitumen (as defined by the tests and/or rules set out herein), not the total amount of ore. Thus, if ore containing degraded bitumen is present as 30% by weight of the total, the amount of alkaline material added would be 30% of the weight percent set out herein, when calculated on the weight of the total ore present. Thus, where it is desired to use alkaline material in an amount of 0.2 weight % based on the amount of ore containing degraded bitumen, and the ore containing degraded bitumen is blended with other ore to be 30% of the total weight of ore, then the alkaline material would be added in an amount of 0.2 times 30% based on the total ore present, or 0.06wt. %.

Once the ore containing degraded bitumen has passed through the hot water process, addition of the alkaline material is stopped, so that the settling problems associated with alkaline tailings can be kept to a minimum. If the normal treatment of the particular ore (without degraded bitumen) requires addition of some sodium hydroxide or other alkali, the rates of addition are returned to the rates which are normal for treatment of ore which does not contain degraded bitumen.

While any alkaline material which is soluble in water at the process temperature can be used, the preferred material is sodium hydroxide, because of its cheapness and availability. Another preferred material is sodium carbonate, alone or admixed with sodium bicarbonate. Such a mixture is sold under the trademark Geosol™.

Embodiments of the invention will be illustrated by the following examples:

EXAMPLE 1

Microscopic Determination of Froth to Determine Degraded Bitumen

Light microscopy (LM) was used to examine some of the samples. The froths were examined using a Nikon Microphot 2 light microscope provided with incident (reflected light) and transmitted light systems. In the reflectance mode a high-intensity mercury lamp (HBO-100W/2) was combined with a series of filters to enable selection of the intensity and wavelength of the incident beam. A polarizer placed in the incident beam produced polarized incident light, and a second polarizer (analyzer) set at 90E with respect to the polarizer, when rotated a few degrees, provided partially cross-polarized light. By rotating the analyzer a few degrees, the degree of cross polarization could be changed to facilitate the examination of clays and sand particles.

Examination of the samples in the fluorescence mode was performed by selecting the wavelength of the incident beam using a combination of filters that provided a range from 450 nm to 490 nm (blue light). The fluorescence emitted from the incident light was separated using a 515-nm barrier filter.

Instead of light microscopy, some samples were examined using confocal laser scanning microscopy. This technique combines some features of LM and scanning electron microscopy (SEM). Like SEM, which scans microscopic entities with an electron beam, CLSM scans the sample components point-by-point with a finely focussed laser beam. The main advantage of CLSM is that it removes out-of-focus information from the image, facilitating three-dimensional reconstructions and quantitative measurements of height. CLSM allows for simultaneous acquisition of images in two wavelengths, exciting the fluorescence of the bitumen components with blue light (488 nm) and detecting the fluorescence image in the green region (514 nm). Simultaneously, in the second photomultiplier, inorganic components such as clays, which show strong reflections at longer wavelengths (such as 568 or 647 nm) can be detected. Therefore, CLSM eliminates the out-of-focus information and has higher resolution and magnification than LM.

The CLSM examination was carried out using a Bio-Rad MRC-1024 imaging system coupled with a Nikon Microphot 2 light microscope. The instrument is equipped with a krypton/argon mixed-gas laser (15 mW), which can provide lines at 488, 568, and 647 nm. The use of suitable filters allows one to select one of these wavelengths or any combination. The images were acquired using a combination of the 488- and 568-nm laser lines for simultaneous image acquisition in the fluorescence and reflectance modes.

Using the techniques described above, samples of froths obtained from tests run on a commercial hot water bitumen extraction process at the Steepbank Mine of Suncor Energy Inc., in Alberta, Canada, were examined microscopically. To obtain photomicrographs of froths containing degraded bitumen, ore known to contain degraded bitumen was deliberately put through the process.

FIG. 1 shows a comparison of CLSM photomicrographs of two froths obtained from the separation cell at the Steepbank mine hot water process. Froth from normal ore is shown on the left. Froth from ore having degraded bitumen is shown on the right. A third CLSM photomicrograph, below the other two, shows froth from the same ore containing degraded bitumen as on the top right, but the froth has been formed in a laboratory-scale simulation of the hot water process with water containing sodium hydroxide in an amount of 0.2 wt % based on the weight of the ore containing degraded bitumen.

Figure 2:
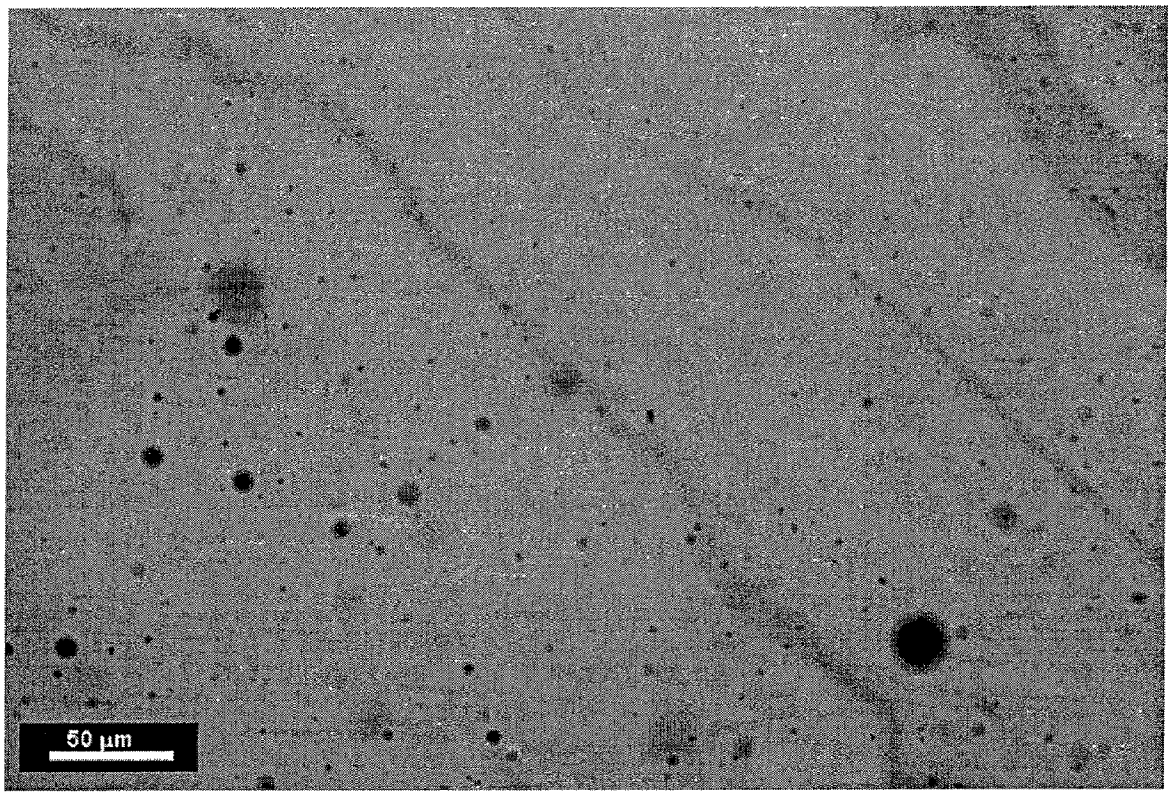
FIG. 2 is a fluorescence photomicrograph of bitumen froth from ore with degraded bitumen, showing dark bands.

FIG. 2 is a fluorescence photomicrograph of froth from commercial ore with degraded bitumen, showing dark bands (areas of lower fluorescence intensity than the remainder) extending diagonally across the photomicrograph from top left to bottom right.

Figure 3:
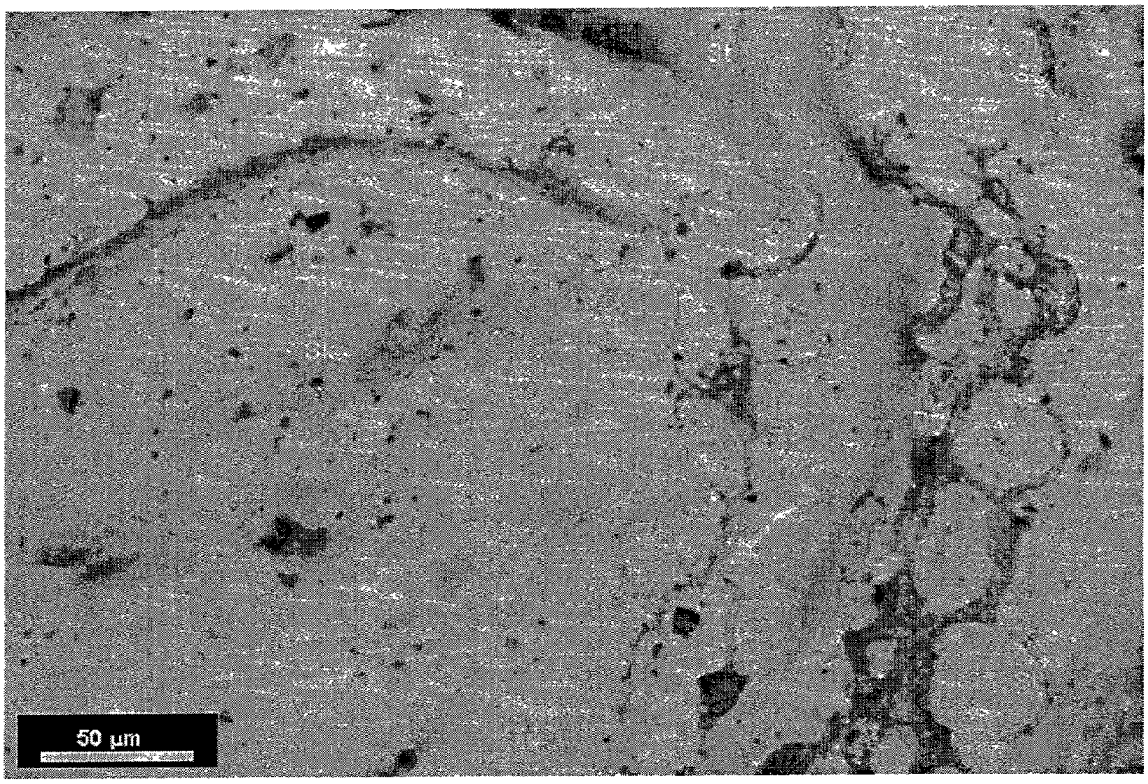
FIG. 3 is a confocal light scanning photomicrograph of a bitumen froth containing several types of degraded bitumen structures.

FIG. 3 is a CLSM photomicrograph of a bitumen froth containing several types of degraded bitumen structures. The photomicrograph has been labelled with "St" for string features, "Sk" for skin features, "D" for dendritic features and "Dn" for dedritic networks. Water droplets appear as dark circles. The white arrow points to the bifurcation of a string to form a dendritic structure.

EXAMPLE 2

Near Infrared Spectroscopy

Figure 4:
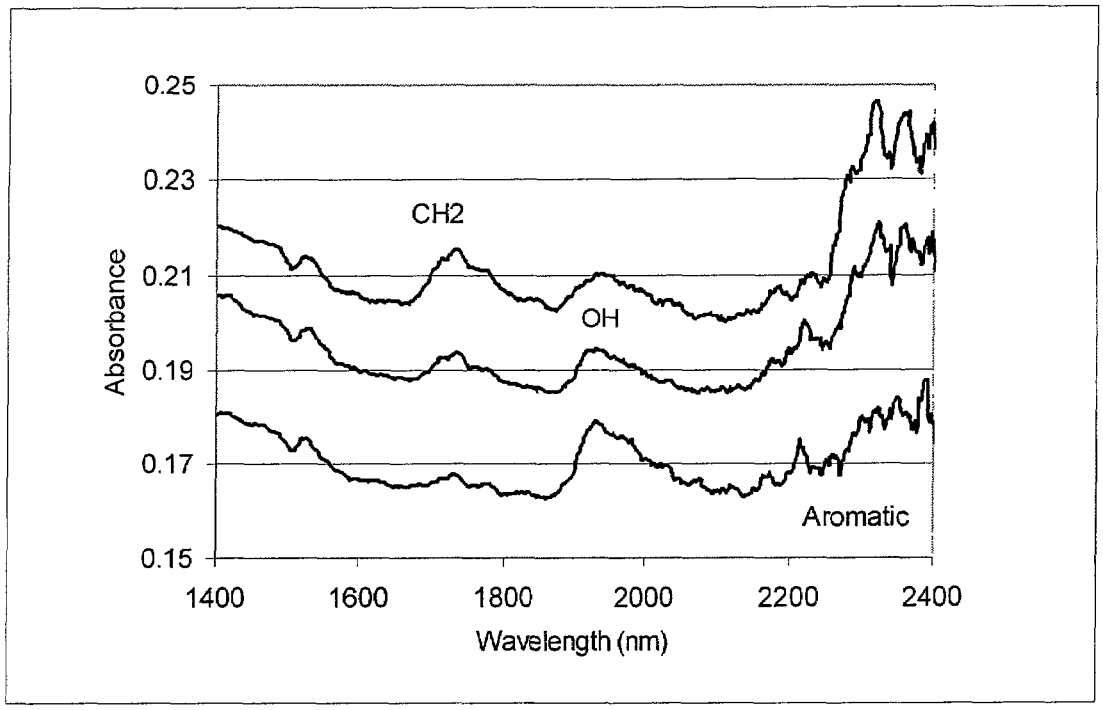
FIG. 4 is a graph showing near-infrared absorbance of three samples of crushed ore having different degrees of bitumen degradation.

Three samples with similar bitumen content but different degrees of bitumen degradation were examined by near infrared spectroscopy. The absorbance traces of the three samples are displayed on the same graph in FIG. 4. The top trace is the least degraded bitumen, and the bottom trace is the most degraded bitumen. It will be noted that as the degradation increases, the $CH_2$ peak decreases, the OH peak becomes more pronounced and the baseline for absorbance decreases.

EXAMPLE 3

Corrective Treatment

A commercial hot water process bitumen extractor at the Steepbank Mine of Suncor Energy Inc. in Alberta Canada was operated with normal ore from the Steepbank mine and no addition of sodium hydroxide. Then, the process was continued with 0.20 pounds of sodium hydroxide per 2200 pounds (1 tonne) of ore. This gave a slight increase in bitumen recovery, but also an increased amount of mineral in the froth.

Following this, the ore was blended with 30% of ore having badly degraded bitumen. On the basis of the amount of ore with degraded bitumen present, the amount of sodium hydroxide was equivalent to about 0.60 pounds of sodium hydroxide per tonne (2200 pounds) of ore with degraded bitumen. After running for two hours with the blended ore, mineral content in the froth was so high that ore addition was stopped to prevent damage to process equipment.

The process was started again after the mineral had passed out of the separator cell. This time, 0.56 pounds of sodium hydroxide was added per tonne of ore present (equivalent to approximately 1.74 pounds of sodium hydroxide per tonne of ore with degraded bitumen, as the ore with degraded bitumen was 30% of the blended feed). The level of mineral in the froth remained within acceptable limits. The feed was stopped after about 1 hour 20 minutes because of a feeder problem unrelated to the froth.

The following table shows the results:

| Time after start Of test | Bitumen % | Mineral % | Water % | Tonnage non-degraded ore (metric tonnes) tph | Tonnage Ore with Degraded bitumen (metric tonnes) tph | Lb. NaOH per metric tonne of total ore present | Lb. NaOH per tonne of ore with degraded bitumen | Comments |
|---|---|---|---|---|---|---|---|---|
| 0 | 52.22 | 9.70 | 36.49 | 8000 | 0 | 0 | 0 | Normal plant conditions - no NaOH Froth figures are hourly average from automatic sampler. |
| 3 | 56.26 | 9.87 | 32.53 | 5500 | | 0.20 | | NaOH addition at 9 usg/min started Feed dropped to 5500 tph |
| 4 | 60.00 | 10.18 | 27.84 | 5500 | | 00.20 | | |
| 5 | 63.57 | 9.85 | 25.32 | 5500 | 1800 | 0.20 | 0.60 | NaOH unchanged. At 15 minutes before this time point, addition of 1800 tph (30% of total ore) of ore with degraded bitumen started |
| 6 | 52.26 | 17.13 | 28.93 | 5500 | 1800 | 0.20 | 0.60 | Mineral readings very high. All ore supply stopped to prevent equipment plugging |

-continued

| Time after start Of test | Bitumen % | Mineral % | Water % | Tonnage non-degraded ore (metric tonnes) tph | Tonnage Ore with Degraded bitumen (metric tonnes) tph | Lb. NaOH per metric tonne of total ore present | Lb. NaOH per tonne of ore with degraded bitumen | Comments |
|---|---|---|---|---|---|---|---|---|
| 7 | 0 | 0 | 0 | 5000 | 0 | 0 | | No froth overflow. Normal ore supply resumes at 5000 tph No NaOH |
| 8 | 66.03 | 9.22 | 22.66 | 5000 | 0 | 0 | | Process functioning normally. |
| 9 | 69.81 | 8.25 | 12.5 | 0 | 0 | 0 | | Hourly average from automatic sampler for froth values. No froth overflow at time point, because ore supply stopped five minutes before time point. At 20 minutes after time point, begin feeding 30% ore with degraded bitumen and NaOH at 23 usg/min. |
| 10 | 65.26 | 7.21 | 26.10 | 5000 | 1600 | 0.56 | 1.74 | |
| 11 | 62.66 | 6.77 | 28.53 | 0 | 0 | 0 | | All ore feed stopped 20 minutes before this time point, sue to unrelated feed problem. |

The bitumen, mineral and water figures are from samples of the bitumen foam as measured in samples taken manually at the separator, except for the two sets of figures labelled "automatic sampler". These two sets are averages over the preceding hour of figures from an automatic sensor at the deaerator.

EXAMPLE 4

Variations of Amount of Alkaline Material in Corrective Treatment

Tests were carried out in a batch hot water (Clark process) bitumen extraction process at Suncor Energy Inc., Steepbank Mine, Alberta, Canada. In each case, the process was run with the same crushed ore. The ore was a high grade, low fines ore, but the bitumen in it was found to be degraded by microscopic inspection as described in Example 1. Runs were made with and without of sodium hydroxide, and the recovery of bitumen (based on the bitumen in the froth) was noted. The results were as follows:

| | | |
|---|---|---|
| 0.2 wt. % NaOH | at 80° C. | 97% recovery |
| 0.0 wt. % NaOH | at 80° C. | 58% recovery |

EXAMPLE 5

Variations of Alkaline Material in Corrective Treatment

Further runs were made in the process described in Example 3, using 30% ore with degraded bitumen, as in that example:

With 0.12 wt % NaOH, based on the amount of ore with degraded bitumen, the results were satisfactory. Froth containing less than 10% mineral and good levels of bitumen recovery was obtained.

With amounts of Geosol™ (a proprietary mixture of sodium carbonate and sodium bicarbonate) ranging from 2.8 lb/metric tonne of degraded ore to 13.3 lb/metric tonne of degraded ore (approximately 0.13 wt % to 0.06 wt %), the results were satisfactory. Froth containing less than 10% mineral and good levels of bitumen recovery was obtained.

While the invention has been described with respect to particular embodiments, it will be understood these embodiments are not limiting and that variations will occur to the person skilled in the art when presented with this specification. The full scope of the invention, therefore, is to be ascertained by reference to the appended claims.

What is claimed is:

1. A method of improving a warm water or hot water extraction process for extracting bitumen from ore, the method comprising:

(a) identifying bitumen in the ore as degraded or undegraded; and (b) supplying a greater amount of alkaline material to the extraction process if the bitumen is identified as degraded than an amount of alkaline material that is supplied to the extraction process if the bitumen is identified as undegraded.

2. The method of claim 1 wherein identifying comprises identifying the bitumen as degraded or undegraded independently of the quantity or concentration of bitumen contained in the ore.

3. The method of claim 1 wherein identifying comprises identifying the bitumen as degraded if the ore has been weathered.

4. The method of claim 3 wherein identifying comprises identifying the bitumen as degraded if the ore has been weathered over geological time periods.

5. The method of claim 4 wherein identifying comprises identifying the bitumen as degraded if the ore was obtained from within less than about 12 meters below ground level.

6. The method of claim 3 wherein identifying comprises identifying the bitumen as degraded if the ore has been exposed to the elements for at least one month.

7. The method of claim 3 wherein identifying comprises identifying the bitumen as degraded if the ore was obtained from within 12 meters of an underground aquifier.

8. The method of claim 1 wherein identifying comprises identifying the bitumen as degraded if a froth made from the bitumen contains water and mineral agglomerations longer than 100 micrometers.

9. The method of claim 1 wherein identifying comprises identifying the bitumen as degraded if a froth made from the bitumen contains at least one morphological feature selected from the group consisting of: (i) string structures; (ii) skin or flat structures; (iii) dendritic structures; and (iv) sheet and globule structures.

10. The method of claim 1 wherein identifying comprises identifying the bitumen as degraded if a froth made from the bitumen exhibits dark bands when fluoresced under a microscope.

11. The method of claim 1 wherein identifying comprises identifying the bitumen as degraded if a near infrared reflectance (NIR) spectrum of a froth made from the bitumen exhibits at least one of: (i) a baseline absorbance decreased by at least 20% relative to known undegraded bitumen; (ii) a $CH_2$ peak intensity decreased by at least 20% relative to known undegraded bitumen; and (iii) an OH peak intensity increased by at least 20% relative to known undegraded bitumen.

12. The method of claim 1 wherein supplying a greater amount comprises supplying at least 0.05 wt % alkaline material to the extraction process.

13. The method of claim 1 wherein supplying a greater amount comprises supplying at least 0.1 wt % alkaline material to the extraction process.

14. The method of claim 1 wherein supplying a greater amount comprises supplying at least 0.15 wt % alkaline material to the extraction process.

15. The method of claim 1 wherein supplying comprises supplying sodium hydroxide to the extraction process.

16. The method of claim 1 wherein supplying comprises supplying sodium carbonate to the extraction process.

17. The method of claim 16 wherein supplying comprises supplying a mixture of sodium carbonate and sodium bicarbonate to the extraction process.

18. The method of claim 1 wherein the amount of alkaline material that is supplied to the extraction process if the bitumen is identified as undegraded is less than 0.03 wt %.

19. The method of claim 18 wherein the amount of alkaline material that is supplied to the extraction process if the bitumen is identified as undegraded is zero.

20. The method of claim 1 further comprising, if the bitumen in the ore is identified as degraded, blending the ore with additional non-degraded ore prior to commencement of the extraction process.

* * * * *

UNITED STATES PATENT AND TRADEMARK OFFICE

CERTIFICATE OF CORRECTION

PATENT NO. : 7,399,406 B2
APPLICATION NO. : 10/136332
DATED : July 15, 2008
INVENTOR(S) : Mikula et al.

It is certified that error appears in the above-identified patent and that said Letters Patent is hereby corrected as shown below:

Title Page Item [56], Page 2, Column 1, Line 12, "Water Procesing" should be changed to --Water Processing--

Title Page Item [56], Page 2, Column 2, Line 1, "(1978)" should be changed to --(1987)--

Title Page Item [56], Page 2, Column 2, Line 3, "Oil Sands" should be changed to --Oil Sand--

Column 4, Line 43, "significant amount" should be changed to --significant amounts--

Column 4, Line 45, "inclusion having" should be changed to --inclusions having--

Column 4, Line 46, "20 micrometer." should be changed to --20 micrometers.--

Column 4, Line 48, "inclusion which" should be changed to --inclusions which--

Column 4, Line 49, "or more in lenght." should be changed to --or more in length.--

Column 4, Line 51, "100 micrometer" should be changed to --100 micrometers--

Column 8, Line 8, "for dedritic networks." should be changed to --for dendritic networks.--

Column 10, Line 57, Claim 7 "underground aquifier." should be changed to --underground aquifer.--

Signed and Sealed this

Eleventh Day of August, 2009

David J. Kappos

David J. Kappos
*Director of the United States Patent and Trademark Office*